US006673499B2

(12) United States Patent
Lee et al.

(10) Patent No.: US 6,673,499 B2
(45) Date of Patent: Jan. 6, 2004

(54) ORGANOPHOTORECEPTOR HAVING AN IMPROVED GROUND STRIPE

(75) Inventors: Nam Jeong Lee, Seoul (KR); Zbigniew Tokarski, Woodbury, MN (US); Kam Wah Law, Woodbury, MN (US)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/003,466

(22) Filed: Oct. 23, 2001

(65) Prior Publication Data

US 2002/0122997 A1 Sep. 5, 2002

Related U.S. Application Data

(60) Provisional application No. 60/243,611, filed on Oct. 26, 2000.

(51) Int. Cl.[7] ..... G03G 5/10

(52) U.S. Cl. ..... 430/57.1; 430/62; 430/117; 252/511; 524/495; 399/162

(58) Field of Search ..... 430/56, 117, 57.1, 430/62; 524/495, 268, 430, 437; 399/162; 252/511

(56) References Cited

U.S. PATENT DOCUMENTS

| | | | | |
|---|---|---|---|---|
| 4,467,023 A | | 8/1984 | Chu et al. | 430/66 |
| 4,547,311 A | | 10/1985 | Sako et al. | 252/511 |
| 4,664,995 A | | 5/1987 | Horgan et al. | 430/59 |
| 4,705,646 A | | 11/1987 | DuPont et al. | 252/511 |
| 4,740,426 A | | 4/1988 | Tremper, III | 428/423.7 |
| 5,008,167 A | | 4/1991 | Yu | 430/56 |
| 5,096,795 A | * | 3/1992 | Yu | 430/59 |
| 5,262,219 A | | 11/1993 | Yamamoto et al. | 428/141 |
| 5,382,486 A | | 1/1995 | Yu et al. | 430/56 |
| 5,466,551 A | | 11/1995 | Yuh et al. | 430/63 |
| 5,643,706 A | | 7/1997 | Brillson et al. | 430/127 |
| 5,686,214 A | * | 11/1997 | Yu | 430/58 |
| 5,958,303 A | | 9/1999 | Narkis et al. | 252/511 |

* cited by examiner

*Primary Examiner*—John Goodrow
(74) *Attorney, Agent, or Firm*—Mark A. Litman & Assoc. P.A.

(57) ABSTRACT

An organophotoreceptor comprising (a) at least one photoconductive element capable of retaining an electrophotographic latent image;

(b) an electrically conductive substrate having an electrically conductive surface;

(c) an electrically conductive ground stripe adjacent to the photoconductive element and in electrical contact with the electrically conductive substrate, wherein the electrically conductive ground stripe comprising a film forming binder, conductive particles, inorganic particles having a Mohs hardness greater than 5, and a surfactant;

(d) at least a charge transport compound; and (e) at least a charge generating compound.

39 Claims, 3 Drawing Sheets

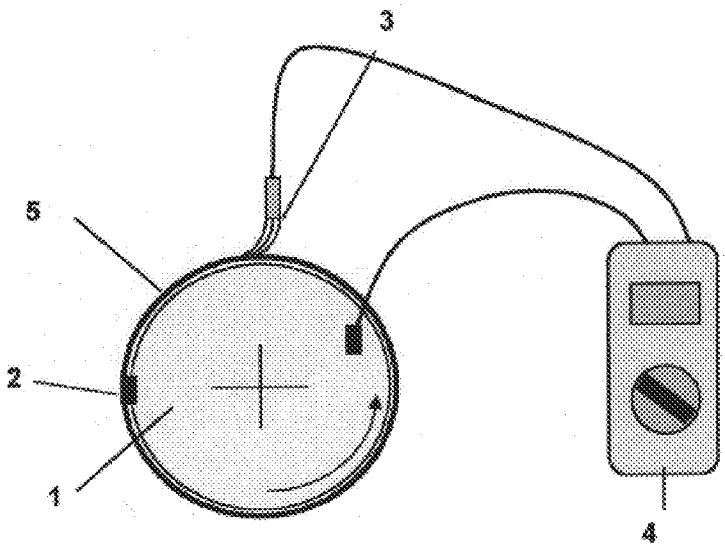
Figure 1. Schematic of the Abrasion-resistance Test

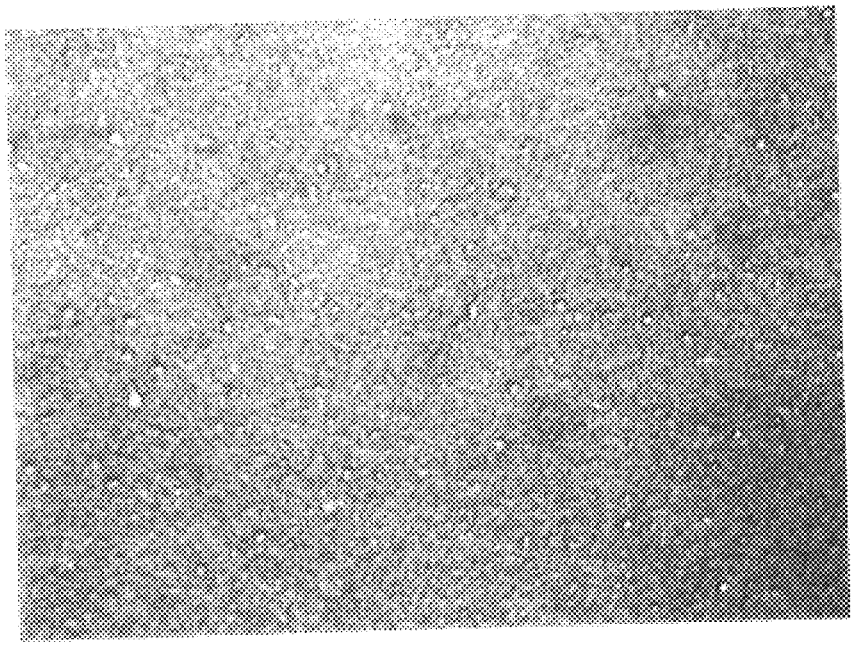
Figure 2. A Micrograph Of Example 1
(320 X)
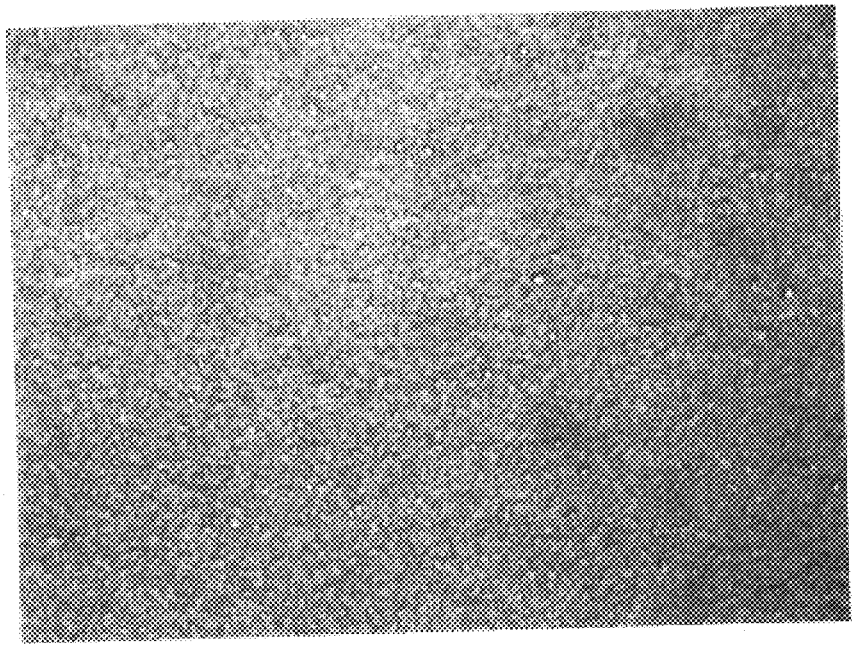
Figure 3. A Micrograph Of Example 2
(320 X)

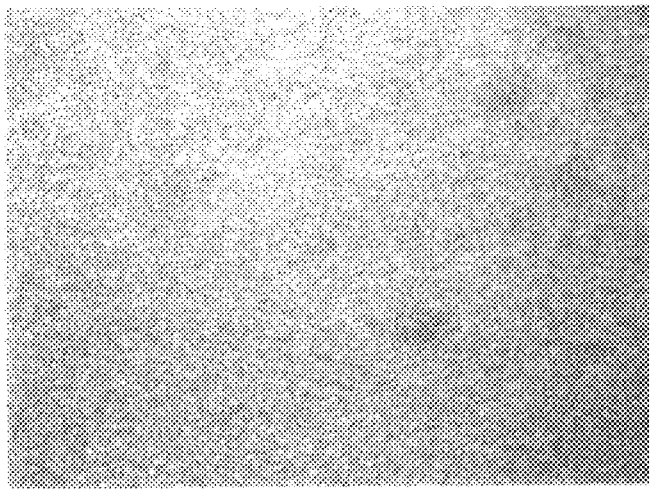
Figure 4. A Micrograph Of Example 3
(320 X)

ORGANOPHOTORECEPTOR HAVING AN IMPROVED GROUND STRIPE

This application claims the benefit of provisional application No. 60/243,611 filed on Oct. 26, 2000.

BACKGROUND OF THE INVENTION

1. Field of the Invention

This invention relates in general to electrophotography and, more specifically, to a flexible organophotoreceptor having a novel electrically conductive ground stripe.

2. Background of the Art

In electrophotography, an organophotoreceptor in the form of a plate, belt, or drum having an electrically insulating photoconductive element on an electrically conductive substrate is imaged by first uniformly electrostatically charging the surface of the photoconductive layer, and then exposing the charged surface to a pattern of light. The light exposure selectively dissipates the charge in the illuminated areas, thereby forming a pattern of charged and uncharged areas. A liquid or solid toner is then deposited in either the charged or uncharged areas to create a toned image on the surface of the photoconductive layer. The resulting visible toner image can be transferred to a suitable receiving surface such as sheets of material, including, for example, paper, polymeric film, metal, metal coated substrates, composites and the like. The imaging process can be repeated many times on the reusable photoconductive layer.

Both single layer and multilayer photoconductive elements have been used. In the single layer embodiment, a charge transport material and charge generating material are combined with a polymeric binder and the combined materials are then deposited on the electrically conductive substrate. In the multilayer embodiment, the charge transport material and charge generating material are in the form of separate layers, each of which can optionally be combined with a polymeric binder, and deposited on the electrically conductive substrate. At least two arrangements are possible. In one arrangement (the "dual layer" arrangement), the charge generating layer is deposited on the electrically conductive substrate and the charge transport layer is deposited on top of the charge generating layer. In an alternate arrangement (the "inverted dual layer" arrangement), the order of the charge transport layer and charge generating layer is reversed.

In both the single and multilayer photoconductive elements, the purpose of the charge generating material is to assist in the generation of charge carriers (i.e., holes or electrons) upon exposure to light. The purpose of the charge transport material is to assist in accepting these charge carriers and transport them through the charge transport layer in order to discharge a surface charge on the photoconductive element.

In order to properly image an organophotoreceptor, the electrically conductive substrate must be brought into electrical contact (e.g., by establishing an electrically conductive path) with a source of fixed potential elsewhere in the imaging device. This electrical contact must be effective over many thousands of imaging cycles in automatic imaging devices. Since the electrically conductive substrate frequently comprises a thin metal layer on a thermoplastic film, long life cannot be achieved easily with an ordinary electrical contact that rubs directly against the thin metal layer. One approach to minimize the wear of the thin metal layer is to use a grounding brush. However, the grounding brush still wears or abrades the thin metal layer over time.

Another approach to improving electrical contact between the electrically conductive substrate of flexible organophotoreceptors and a grounding means is the use of an electrically conductive ground stripe. The stripe is in contact with the electrically conductive substrate and is adjacent to one edge of the photoconductive element. Generally the ground stripe comprises opaque conductive particles dispersed in a film-forming binder. This approach to grounding the electrically conductive substrate increases the overall life of the organophotoreceptor, because the ground stripe is more durable than the thin metal layer. However, such a ground stripe is still subject to erosion and wetting problems.

Erosion is particularly severe in electrophotographic imaging systems utilizing metallic grounding brushes or sliding metal contacts. The conductive particles formed during erosion of the ground stripe tend to drift and settle on other components of the machine to adversely affect machine performance and appearance. Another problem due to the erosion of the ground stripe is that the electrical conductivity of the ground stripe can decline to unacceptable levels after extended usage.

Erosion of the ground stripe also causes problems in systems using a timing light in combination with a timing aperture or a timing reflective mark in the ground stripe for controlling various functions of imaging devices, such as seam detection, cycle detection, and registration. If a timing aperture is used and the ground stripe and the underlying thin metal layer are worn away by erosion, the eroded area becomes transparent and thereby allows light to pass through it. This can create false timing signals, which in turn can cause the imaging device to malfunction. If a timing reflective mark is used and the ground stripe is worn away by erosion and the thin metal layer is exposed, the eroded area becomes reflective and thereby reflects light and creates false timing signals which also cause the imaging device to malfunction.

A wetting problem arises when a ground stripe dispersion is coated on a sub-layer on the thin metal layer and the dispersion does not spread uniformly. Such a wetting problem results in pinholes in the ground stripe after drying. The pinholes cause similar timing problems as described in the previous paragraph.

The above-mentioned problems associated with the use of a ground stripe in flexible organophotoreceptors are undesirable in electrophotographic imaging systems. Therefore, there is a need to improve the durability and conductivity stability of the ground stripe, and the wettability of the ground stripe formulation.

SUMMARY OF THE INVENTION

One aspect of this invention is to provide a ground stripe which overcomes the above-mentioned disadvantages so that it provides an organophotoreceptor having a durable life, a stable conductivity over time, and no pinholes.

In a first aspect, the invention features an organophotoreceptor that includes (a) at least one photoconductive element capable of retaining an electrophotographic latent image;

(b) an electrically conductive substrate having an electrically conductive surface; and (c) an electrically conductive ground stripe adjacent to the photoconductive element and in electrical contact with the electrically conductive substrate, wherein the electrically conductive ground stripe comprises a film-forming binder, conductive particles, inorganic particles having a Moh hardness greater than 5 (it is possible to provide both the conductive function and the Mohs hardness function in a single particle, but different particles are preferred), and a surfactant;

(d) at least one charge transport compound; and (e) at least one charge generating compound In a second aspect, the invention features an electrophotographic imaging apparatus that includes (a) a plurality of support rollers, at least one support roller having a diameter no greater than about 40 mm; and (b) the above-described organophotoreceptor being in the form of a flexible belt threaded around the support rollers (e.g., a flexible support such as a belt having a flexible coating on at least one surface thereof, the coating comprising a binder, surfactant, conductive particles, and inorganic particles having a Moh hardness greater than 5). The apparatus preferably further includes a liquid toner dispenser.

In a third aspect, the invention features an electrophotographic imaging process that includes (a) applying an electrical charge to a surface of the above-described organophotoreceptor; (b) imagewise exposing the surface of the organophotoreceptor to radiation to dissipate charge in selected areas and thereby form a pattern of charged and uncharged areas on the surface; (c) contacting the surface with a liquid toner that includes a dispersion of colorant particles in an organic liquid to create a toned image; and (d) transferring the toned image to a substrate.

In a fourth aspect, the invention features an electrically conductive ground stripe that includes:

(a) a film forming binder;

(b) conductive particles;

(c) inorganic particles having a Mohs hardness greater than 5; and (d) a surfactant.

In a fifth aspect, the invention features a process of making a ground stripe comprising the steps of:

(a) dispersing inorganic particles having a Mohs hardness greater than 5 in a first liquid to form an inorganic particle dispersion;

(b) dispersing a mixture of conductive particles, a surfactant, a binder, and the inorganic particle dispersion in a second liquid to form a ground stripe dispersion;

(c) coating the ground stripe dispersion on a substrate; and (d) drying the ground stripe dispersion on the substrate.

It is to be noted that even though these steps are described in an apparent order, restriction to that order is not necessarily essential. For example, a first blend of mixture of conductive particles, a surfactant, and a binder may be dispersed, a dispersion made of the hard particles in the first liquid, and then the complete dispersion step (b) would be performed. Similarly, where the term dispersion is used, a suspension that is sufficiently stable as to enable the coating to be applied may also be used, although a true dispersion is preferred.

In a sixth aspect, the invention features a process of making a ground stripe comprising the steps of:

(a) dispersing inorganic particles having a Mohs hardness greater than 5 in a first liquid to form an inorganic particle dispersion;

(b) dispersing a mixture of conductive particles, a surfactant, and a binder in a second liquid to form a conductive particle dispersion;

(c) mixing or dispersing the inorganic particle dispersion and the conductive particle dispersion together to form a ground stripe dispersion;

(d) coating the ground stripe dispersion on a substrate; and (e) drying the ground stripe dispersion on the substrate In a seventh aspect, the invention features a process of making a ground stripe comprising the steps of:

(a) dispersing inorganic particles having a Mohs hardness greater than 5 in a first liquid to form an inorganic particle dispersion;

(b) dispersing a mixture of conductive particles, a binder, and the inorganic particle dispersion in a second liquid to form a ground stripe dispersion;

(c) mixing or dispersing the ground stripe dispersion with a surfactant;

(d) coating the ground stripe dispersion on a substrate; and (e) drying the ground stripe dispersion on the substrate.

In addition to drying the coating, the binder component and/or part of the liquid component may be polymerizable or crosslinkable, so the 'drying' step could include polymerization, curing, thermal polymerization, photopolymerization, and the like.

The invention provides novel ground stripes for organophotoreceptors featuring a combination of good mechanical, conductive, and electrostatic properties. These organophotoreceptors can be used successfully with powder or liquid toners to produce high quality images. The high quality of the images is maintained after repeated cycling.

Other features and advantages of the invention will be apparent from the following description of the preferred embodiments thereof, and from the claims.

BRIEF DESCRIPTION OF THE FIGURES

FIG. 1 shows a schematic of the Abrasion-resistance Test.

FIG. 2 shows a micrograph of Example 1 at 320X.

FIG. 3 shows a micrograph of Example 2 at 320X.

FIG. 4 shows a micrograph of Example 3 at 320X.

DETAILED DESCRIPTION OF THE INVENTION

The invention describes organophotoreceptors that include ground stripes having the compositions set forth in the Summary of the Invention above. The organophotoreceptor may be in the form of a plate, sheet, drum, or belt, with flexible belts being a preferred embodiment. The organophotoreceptor may include an electrically conductive substrate and a photoconductive element in the form of a single layer that includes both the charge transport compound and charge generating compound in a polymeric binder. Preferably, however, the organophotoreceptor includes an electrically conductive substrate and a photoconductive element that is a bilayer construction featuring a charge generating layer and a separate charge transport layer. The charge generating layer may be located intermediate the electrically conductive substrate and the charge transport layer. Alternatively, the photoconductive element may be an inverted construction in which the charge transport layer is intermediate the electrically conductive substrate and the charge generating layer.

The electrically conductive substrate may be flexible, for example in the form of a flexible web or a belt, or inflexible, for example in the form of a drum. Typically, a flexible electrically conductive substrate comprises of an insulated substrate and a thin layer of an electrically conductive material. The insulated substrate may be paper or a film forming polymer such as a polyester such as polyethylene terephthalate (Dupont A and Dupont 442, commercially available from E. I. DuPont de Nemours & Company), polyimide, polysulfone, polyethylene naphthalate, polypropylene, nylon, polyester, polycarbonate, vinyl resins such as polyvinyl fluoride and polystyrene, and the like. Specific examples of supporting substrates included polyethersulfone (Stabar® S-100, commercially available from ICI), polyvinyl fluoride (Tedlar®, commercially available from E. I. DuPont de Nemours & Company), polybisphenol-A polycarbonate (Makrofol®, commercially available from Mobay Chemical Company) and amorphous polyethylene terephthalate (Melinar®, commercially available from ICI Americas, Inc.). The electrically conductive material may be graphite, carbon black, iodide, conductive polymers such as polypyroles and Calgon® Conductive polymer 261 (commercially available from Calgon Corporation, Inc., Pittsburgh, Pa.), metals such as aluminum, titanium, chromium, brass, gold, copper, palladium, nickel, or stainless steel, or metal oxide such as tin oxide or indium oxide. Preferably, the electrically conductive material is aluminum or indium tin oxide. Typically, the insulated substrate will have a thickness adequate to provide the required mechanical stability. For example, flexible web substrates generally have a thickness from about 0.01 to about 1 mm, while drum substrates generally have a thickness of from about 0.5 mm to about 2 mm.

The charge generating compound is a material which is capable of absorbing light to generate charge carriers, such as a dyestuff or pigment. Examples of suitable charge generating compounds include metal-free phthalocyanines, metal phthalocyanines such as titanium phthalocyanine, copper phthalocyanine, oxytitanium phthalocyanine, hydroxygallium phthalocyanine, squarylium dyes and pigments, hydroxy-substituted squarylium pigments, perylimides, polynuclear quinones available from Allied Chemical Corporation under the tradename Indofast® Double Scarlet, Indofast® Violet Lake B, Indofast® Brilliant Scarlet and Indofast® Orange, quinacridones available from DuPont under the tradename Monastral® Red, Monastral® Violet and Monastral® Red Y, naphthalene 1,4,5,8-tetracarboxylic acid derived pigments including the perinones, tetrabenzoporphyrins and tetranaphthaloporphyrins, indigo- and thioindigo dyes, benzothioxanthene-derivatives, perylene 3,4,9,10-tetracarboxylic acid derived pigments, polyazo-pigments including bisazo-, trisazo- and tetrakisazo-pigments, polymethine dyes, dyes containing quinazoline groups, tertiary amines, amorphous selenium, selenium alloys such as selenium-tellurium, selenium-tellurium-arsenic and selenium-arsenic, cadmium sulfoselenide, cadmiumselenide, cadmium sulfide, and mixtures thereof. Preferably, the charge generating compound is oxytitanium phthalocyanine, hydroxygallium phthalocyanine or a combination thereof.

Preferably, the charge generation layer comprises a binder in an amount of from about 10 to about 90 weight percent and more preferably in an amount of from about 20 to about 75 weight percent, based on the weight of the charge generation layer.

There are many kinds of charge transport materials available for electrophotography. Suitable charge transport materials for use in the charge transport layer include, but are not limited to, pyrazoline derivatives, fluorine derivatives, oxadiazole derivatives, stilbene derivatives, hydrazone derivatives, carbazole hydrazone derivatives, triaryl amines, polyvinyl carbazole, polyvinyl pyrene, or polyacenaphthylene.

The charge transport layer typically comprises a charge transport material in an amount of from about 25 to about 60 weight percent, based on the weight of the charge transport layer, and more preferably in an amount of from about 35 to about 50 weight percent, based on the weight of the charge transport layer, with the remainder of the charge transport layer comprising the binder, and optionally any conventional additives. The charge transport layer will typically have a thickness of from about 10 to about 40 microns and may be formed in accordance with any conventional technique known in the art.

Conveniently, the charge transport layer may be formed by dispersing or dissolving the charge transport material and a polymeric binder in organic solvent, coating the dispersion and/or solution on the respective underlying layer and hardening (e.g., curing, polymerizing or drying) the coating. Likewise, the charge generation layer may be formed by dissolving or dispersing the charge generation compound and the polymeric binders in organic solvent, coating the solution or dispersion on the respective underlying layer and hardening (e.g., curing, polymerizing or drying) the coating.

The binder is capable of dispersing or dissolving the charge transport compound (in the case of the charge transport layer) and the charge generating compound (in the case of the charge generating layer). Examples of suitable binders for both the charge generating layer and charge transport layer include polystyrene-co-butadiene, modified acrylic polymers, polyvinyl acetate, styrene-alkyd resins, soya-alkyl resins, polyvinylchloride, polyvinylidene chloride, polyacrylonitrile, polycarbonates, polyacrylic acid, polyacrylates, polymethacrylates, styrene polymers, polyvinyl butyral, alkyd resins, polyamides, polyurethanes, polyesters, polysulfones, polyethers, polyketones, phenoxy resins, epoxy resins, silicone resins, polysiloxanes, poly (hydroxyether) resins, polyhydroxystyrene resins, novolak, poly(phenylglycidyl ether)-co-dicyclopentadiene, copolymers of monomers used in the above-mentioned polymers, and combinations thereof. Polycarbonate binders are particularly preferred for the charge transport layer, whereas polyvinyl butyral and polyester binders are particularly preferred for the charge generating layer. Examples of suitable polycarbonate binders for the charge transport layer include polycarbonate A which is derived from bisphenol-A, polycarbonate Z, which is derived from cyclohexylidene bisphenol, polycarbonate C, which is derived from methylbisphenol A, and polyestercarbonates.

The photoreceptor may include additional layers as well. Such layers are well-known and include, for example, barrier layers, release layers, adhesive layer, and sub-layer. The release layer forms the uppermost layer of the photoconductor element with the barrier layer sandwiched between the release layer and the photoconductive element. The adhesive layer locates and improves the adhesion between the barrier layer and the release layer. The sub-layer is a charge blocking layer and is located between the electrically conductive substrate and the photoconductive element. The sub-layer may also improve the adhesion between the electrically conductive substrate and the photoconductive element.

Suitable barrier layers include coatings such as crosslinkable siloxanol-colloidal silica coating and hydroxylated silsesquioxane-colloidal silica coating, and organic binders such as polyvinyl alcohol, methyl vinyl ether/maleic anhydride copolymer, casein, polyvinyl pyrrolidone, polyacrylic acid, gelatin, starch, polyurethanes, polyimides, polyesters, polyamides, polyvinyl acetate, polyvinyl chloride, polyvinylidene chloride, polycarbonates, polyvinyl butyral, polyvinyl acetals such as acetoacetals and polyvinyl formal and polyvinyl butyral, polyacrylonitrile, polymethyl methacrylate, polyacrylates, polyvinyl carbazoles, copolymers of monomers used in the above-mentioned polymers, vinyl resins such as vinyl chloride/vinyl acetate/vinyl alcohol terpolymers, vinyl chloride/vinyl acetate/maleic acid terpolymers, ethylene/vinyl acetate copolymers, vinyl chloride/vinylidene chloride copolymers, cellulose polymers, and mixtures thereof. The above organic binders optionally may contain small inorganic particles such as fumed silica, silica, titania, alumina, zirconia, or a combination thereof. The typical particle size is in the range of 0.001 to 0.5 micrometers, preferably 0.005 micrometers. A preferred barrier layer is a 1:1 mixture of methyl cellulose and methyl vinyl ether/maleic anhydride copolymer with glyoxal as a crosslinker.

The release layer topcoat may comprise any release layer composition known in the art. Preferably, the release layer is a fluorinated polymer, siloxane polymer, fluorosilicone polymer, silane, polyethylene, polypropylene, or a combination thereof. More preferably, the release layers comprises crosslinked silicone polymers.

Typical adhesive layers include film forming polymers such as polyester, polyvinylbutyral, polyvinylpyrolidone, polyurethane, polymethyl methacrylate, poly(hydroxy amino ether) and the like. Preferably, the adhesive layer comprises poly(hydroxy amino ether). If such layers are utilized, they preferably have a dry thickness between about 0.01 micrometer and about 5 micrometers.

Typical sub-layers include polyvinylbutyral, organosilanes, hydrolyzable silanes, epoxy resins, polyesters, polyamides, polyurethanes, silicones and the like. Preferably, the sub-layer has a dry thickness between about 20 Angstroms and about 2,000 Angstroms.

The novel ground stripes, and photoreceptors including these ground stripes, are suitable for use in an imaging process with either dry or liquid toner development. Liquid toner development is generally preferred because it offers the advantages of providing higher resolution images and requiring lower energy for image fixing compared to dry toners. Examples of useful liquid toners are well-known. They typically include a colorant, a resin binder, a charge director, and a carrier liquid. A preferred resin to pigment ratio is 2:1 to 10:1, more preferably 4:1 to 8:1. Typically, the colorant, resin, and the charge director form the toner particles.

Any suitable electrically conductive particles may be used in the electrically conductive ground stripe of this invention. Typical electrically conductive particles include carbon black, graphite, conducting polymers, vanadium oxide, copper, silver, gold, nickel, tantalum, chromium, zirconium, vanadium, niobium, indium tin oxide, and the like. The electrically conductive particles may have any suitable shape. Typical shapes include irregular, granular, spherical, elliptical, cubic, flake, filament, and the like. Preferably, the electrically conductive particles should have a particle size less than the thickness of the electrically conductive ground stripe to avoid an electrically conductive ground stripe having an excessively irregular outer surface. More preferably, the electrically conductive particles should have a particle size less than 10 micrometers.

The concentration of the electrically conductive particles to be used in the ground stripe depends on factors such as the particle size and conductivity of the specific electrically conductive particles utilized. Generally, the concentration of the electrically conductive particles in the ground stripe is less than about 40 percent by weight based on the total weight of the dried ground stripe in order to maintain sufficient strength and flexibility for flexible ground stripe. Good results have been achieved with about 25 percent by weight carbon black based on the total weight of the dried ground stripe. Sufficient conductive particle concentration is achieved in the dried ground stripe when the surface resistivity of the ground stripe is less than about $1\times10^6$ ohms per square. Preferably, the surface resistivity of the ground stripe is less than about $1\times10^4$ ohms per square.

Any suitable inorganic particle having Mohs hardness greater than 5 may be used in this invention. Typical inorganic particles having Mohs hardness greater than 5 include silicon dioxide, aluminum oxide, titanium dioxide, alpha-$Fe_2O_3$, $Fe_3O_4$, MgO, $SnO_2$, $ZrO_2$, quartz, topaz, $MgAl_2O_4$, SiC, diamond, and $BeAl_2O_4$ and the like. Preferably, the inorganic particle is aluminum oxide, titanium dioxide, $ZrO_2$, $SiO_2$, or a combination thereof. The inorganic particles should have a particle size less than the thickness of the ground stripe to avoid the ground stripe having an irregular outer surface. An average inorganic particle size between about 0.3 micrometer and about 5 micrometers is preferred to achieve a relatively smooth outer surface that does not unduly abrade and prematurely shorten the life of contacting grounding devices.

Generally, for flexible electrophotographic imaging members, the electrically conductive ground stripe comprises from about 5 percent by weight to about 40 percent, preferably from 20% to about 40%, by weight of inorganic particles, based on the total weight of the dried electrically conductive ground stripe layer. A concentration of inorganic particles greater than about 40 percent by weight tends to render the electrically conductive ground stripe inadequately conductive for practical use as a ground plane and unduly reduces the flexibility of the electrically conductive ground stripe. Preferably, the inorganic particles should have a particle size less than the thickness of the ground stripe to avoid the ground stripe having an irregular outer surface. An average inorganic particle size between about 0.3 micrometer and about 5 micrometers is preferred to achieve a relatively smooth outer surface that does not unduly abrade and prematurely shorten the life of contacting grounding devices. When less than about 5 percent by weight of the crystalline particles are utilized, the improvement in wear resistance is relatively slight.

Typical thermoplastic resins can be used as a binder for the ground stripe. They include polycarbonates, polyesters, polyacrylic acid and its copolymers, polyurethanes, acrylate polymers, methacrylate polymers, cellulose polymers, polyamides, nylon, polybutadiene, poly(vinyl chloride), polyisobutylene, polyethylene, polypropylene, polyterephthalate, polystyrene, styrene-acrylonitrile copolymer, and the like and mixtures thereof. Preferably, the binder is a polyester such as Vitel 2200 (obtained commercially from Shell Chemical Co., Apple Grove, W. Va.)

Optional conventional additives, such as, for example, surfactants, fillers, coupling agents, fibers, lubricants, wetting agents, pigments, dyes, plasticizers, release agents, suspending agents, and curing agents, may be included in the ground stripe of the present invention.

Examples of surfactants include silicone surfactants, fluorinated surfactants, hydrocarbon surfactants, nonionic surfactants such as polyethylene oxide, anionic surfactants such as phosphates, sulfonates, and sulfates, cationic surfactants such as quaternary ammonium salts, alkenyl succinic anhydride derivatives, fatty acids, metallic salts of fatty acids, phosphate esters, ethoxylated fatty acids, ethoxylated fatty amines, ethoxylated glycerides, ethoxylated alcohols and alkyl phenols, fluorinated surfactants, ethoxylated phosphate esters, and biodegradable surfactants. Preferably, the surfactant is a silicone surfactant such as Dow Coming 510 and polysiloxane surfactants.

When a ground stripe dispersion is applied to the surface of a substrate, the above-mentioned surfactants in the ground stripe dispersion help to lower the surface energy of the ground stripe dispersion so that the ground stripe dispersion can spread uniformly on the surface of the substrate and, consequently, there is no pinhole formed in the ground stripe coating. Furthermore, the surfactants disperse the inorganic particles and conductive particles uniformly in the ground stripe coating by interacting chemically or physically with the surfaces of the particles. Finally, the dispersed particles can interact directly or indirectly (through the free ends of the surfactants) with the binder and such interaction increases the overall strength of the coating. Consequently, the use of surfactant results in a highly conductive and durable ground stripe coating without any pinholes.

The fillers usually have a different particle size from the conductive particles or the inorganic particles. Examples of useful fillers for this invention include: metal carbonates (such as calcium carbonate (chalk, calcite, marl, travertine, marble and limestone), calcium magnesium carbonate, sodium carbonate, magnesium carbonate), silica (such as quartz, glass beads, glass bubbles and glass fibers), silicates (such as talc, clays, feldspar, mica, calcium silicate, calcium metasilicate, sodium aluminosilicate, sodium silicate), metal sulfates (such as calcium sulfate, barium sulfate, sodium sulfate, aluminum sodium sulfate, aluminum sulfate), gypsum, vermiculite, wood flour, aluminum trihydrate, carbon black, metal oxides (such as calcium oxide, aluminum oxide, titanium dioxide), and metal sulfites (such as calcium sulfite).

A coupling agent can provide an association bridge between the binder and the inorganic particles. Additionally the coupling agent can provide an association bridge between the binder and the filler particles. Examples of coupling agents include silanes, titanates, and zircoaluminates. There are various means to incorporate the coupling agent. For example, the coupling agent may be added directly to the binder precursor. The binder may contain, for example, anywhere from about 0.01 to 3% by weight coupling agent. Alternatively, the coupling agent may be applied to the surface of the filler particles. In still another embodiment, the coupling agent is applied to the surface of the inorganic particles prior to being incorporated into the ground stripe. The ground stripe may, for example, contain anywhere from about 0.01 to 3% by weight coupling agent.

Any suitable conventional dispersing technique may be utilized to prepare the ground stripe dispersion for coating. The ground stripe can be prepared by simple mixing inorganic particles, conductive particles, a surfactant, a binder, and a liquid, followed by high shear homogenization, ball-milling, attritor milling, high energy bead (sand) milling or other means known in the art for effecting particle size reduction in a dispersion. The liquid can be any common solvent such as methyl ethyl ketone, toluene, acetone, tetrahydrofuran, hydrocarbons such as hexane and heptane, ethanol, methanol, ethyl ether, benzene, xylene, and the like and a combination thereof. The input of mechanical energy to the dispersion during milling acts to break down the inorganic particles and conductive particles into the corresponding primary particles (0.05–10 micron diameter) and to expose new particle surfaces for the surfactant to adhere to, thereby acting to sterically-stabilize the particles with respect to aggregation. The result is a sterically-stabilized ground stripe dispersion which turns into a durable ground stripe after drying. Alternatively, the conductive particles and inorganic particles can be dispersed separately and then combined together to form the final ground stripe dispersion. Another alternative is to disperse the inorganic particles and conductive particle in sequence. The later two milling processes comprise more than one milling step and thus are categorized as a Multi-step Milling Process in this invention. The main objective of these different kinds of dispersion process is to ensure each kind of particles reaching its optimum particle size distribution to provide a durable and highly conductive ground stripe.

Any suitable conventional coating technique may be utilized to apply the ground stripe to the supporting substrate layer. Typical coating techniques include solvent coating, die coating, slot coating, curtain coating, extrusion coating, spray coating, lamination, dip coating, solution spin coating, meniscus coating and the like. The conductive ground stripe is applied directly onto the conductive layer to achieve sufficient electrical contact with the conductive layer. The conductive ground stripe may be applied prior to, simultaneously with, or subsequent to the application of any of the other layers on the conductive layer.

The thickness of the electrically conductive ground stripe should be sufficient to provide a durable electrically conductive layer. For flexible ground stripe layers, the thickness should be thin enough to avoid mechanical failure such as cracking or separation from the underlying layer during passage over rollers and rods. Generally, the thickness of the electrically conductive ground stripe is equal to or less than that of the imaging layer or layers to avoid interference with processing stations during imaging.

Optimum results are obtained when the electrically conductive ground stripe coating mixture has an inorganic particle concentration of between about 10% and about 40% by weight, an electrically conductive particle concentration of between about 10% and about 30% by weight, and a surfactant concentration of between about 0.1% and about 5% by weight, based on the total weight of the dried electrically conductive ground stripe. The electrically conductive particles and inorganic particles in the above formulation are homogeneously dispersed in the polymer matrix to form a durable ground stripe coating. Furthermore, the formulation provides a ground stripe dispersion that wets the substrate uniformly and results in no pinholes in the ground stripe coating. This is particularly desirable for a uniform rate of wear during the life of the imaging member. Surprisingly, the use of a surfactant in this invention provide significantly improved ground stripe compared to ground stripe without the surfactant.

These and other aspects of the present invention are demonstrated in the illustrative examples that follow.

EXAMPLES

Example 1

VITELOR® 2200 (37.8 g, a polyester commercially obtained from Shell Chemical Co., Apple Grove, W. Va.) was dissolved in methyl ethyl ketone/toluene (252.0 g, 2/1 by volume ratio) in a glass jar. The glass jar was covered tightly and oscillated using a shaker until a clear solution was obtained. VULCAN® XC-72R (15.8 g, a carbon black commercially obtained from Cabot, Corp., Boston, Mass.), titanium oxide (6.3 g, commercially obtained from Aldrich Chemical Co., Milwaukee, Wis.), and aluminum oxide (3.2 g, commercially obtained from Fisher Chemical, Fair Lawn, N.J.) were added to the solution and mixed to form a mixture with 20% by weight of solid. Then the mixture was dispersed by an Igarashi mill (commercially obtained from Igarashi milling machine, Aimex Co., Tokyo, Japan) in 0.5 L stainless steel containers with 390 g of glass bead (A130, diameter 1.3 mm, commercially obtained from Potters Industries Inc., Berwyn, Pa.). The mixture was milled for 3 hours at a disc rotating speed of 2000 rpm with cooling water to form a dispersion. The dispersion was diluted with MEK/Toluene solvent to lower the percentage of solid of the dispersion to 12% and then filtered through a 20 micron filter (DFL04, commercially obtained from Porous Media, St. Paul, Minn.).

Example 2

Example 2 was prepared according to the procedure of Example 1 except titanium oxide and aluminum oxide were pre-milled by an Igarashi mill for 1.5 hours in 100 g of methyl ethyl ketone/toluene (2/1 by volume ratio) before they were milled with the VULCAN® XC-72R and VITEL® 2200. There was no surfactant in the formulation.

Example 3

Example 3 was prepared according to the procedure of Example 2 except Dow Corning 510 (0.2% silicone, a surfactant commercially obtained from Dow Corning Corp., Midland, Mich.) was added to the dispersion after milling.

Coating

The dispersions for Examples 1–3 obtained above were coated on the aluminum surface of a polyester film substrate coated with aluminum (0.0762 millimeter (3 mil), Dupon Teijin Melinex® 442, commercially obtained from CP Films, Martinsville, Va.) on a lab coater (T. H. Dixon & Co., commercially obtained from Letchworth, Herts, England). The web speed was fixed at 0.1016 m/s (20 feet/minute), and the temperatures of four drying ovens were set at 100, 110, 110, and 125° C. respectively. A Zenith gear pump was used for supplying the dispersion at a pump speed of 3.0 rpm. The coating thickness was 2.5 microns. Then samples (2.54 cm×21.49 cm) were cut out from the coated web and tested according to the test described below.

The micrographs (FIGS. 2–4) of the surfaces of Examples 1–3 were obtained by an optical microscope (BHZ-UMA, commercially obtained from Olympus Optical Co., Japan) under reflective light and printed by a video printer (UP3000, commercially obtained from Sony, Japan). The micrographs show that Example 3, prepared by the Multi-step Milling Process as described in Detailed Description above and with a surfactant, has the smoothest surface among the examples.

Abrasion-Resistance Test

Examples 1–3 were tested by rotating abrasion-resistance test device 6 as shown in FIG. 1. A sample 5 (2.54 cm×21.49 cm) of each example was wrapped around aluminum drum 1 (diameter=6.84 cm), and a region (5 mm×10 mm) of the sample 5 was removed with methyl ethyl ketone to expose the bare aluminum surface. The aluminum surface was connected electrically to aluminum drum 1 using conductive copper tape 2 (electrical tape, commercially obtained from 3M, St. Paul, Minn.). Grounding brush 3 made of metal fiber was attached to the sample. As aluminum drum 1 rotated at a surface speed of 0.1651 m/s (6.5 in/s), dynamic resistance between grounding brush 3 and aluminum drum 1 was measured with resistance tester 4 (Fluke 73 series multimeter, commercially obtained from Fluke, John Fluke Mfg. Co., Inc.) at 1000, 3000, 6000 and 10000 cycles. The micrographs (FIGS. 2–4) of the surfaces of Examples 1–3 were obtained by an optical microscope (BHZ-UMA, commercially obtained from Olympus Optical Co., Japan) under reflective light and printed by a video printer (UP3000, commercially obtained from Sony, Japan).

Abrasion-Resistance Test Result

Table 1 shows the changes of resistance of Examples 1–3 with cycling according to the procedure described above. The data in Table 1 show that the resistances of Examples 1–3 increase with cycling. However, the increases in the resistances of Examples 2 and 3, which were prepared by the Multi-step Milling Process, are less than that of Example 1, which was prepared by a single milling process. Furthermore, the use of a surfactant also decreases the increase in resistance with cycling, as illustrated by the resistance of Example 3 (with surfactant) and that of Example 2 (without surfactant).

TABLE 1

Resistances of Examples 1–3 at Different Cycles.

| Number of Cycles | Dynamic Resistance of Example 1 (kiloohm) | Dynamic Resistance of Example 2 (kiloohm) | Dynamic Resistance of Example 3 (kiloohm) |
|---|---|---|---|
| 0 | 0.5 | 0.5 | 0.3 |
| 1000 | 9.3 | 7.4 | 6.3 |
| 3000 | 62.0 | 43.1 | 15.6 |
| 6000 | 111.3 | 89.9 | 50.7 |
| 10000 | 160.4 | 133.6 | 63.4 |

We claim:

1. An organophotoreceptor comprising:

(a) at least one photoconductive element capable of retaining an electrophotographic latent image;

(b) an electrically conductive substrate having an electrically conductive surface;

(c) an electrically conductive ground stripe adjacent to the photoconductive element and in electrical contact with the electrically conductive substrate, wherein the electrically conductive ground stripe comprises a film forming binder, conductive particles, inorganic particles having a Mohs hardness greater than 5, and a surfactant;

(d) at least a charge transport compound; and (e) at least a charge generating compound.

2. An organophotoreceptor according to claim 1 wherein the conductive particles are carbon black particles.

3. An organophotoreceptor according to claim 1 wherein the binder is a polyester.

4. An organophotoreceptor according to claim 1 wherein the inorganic particles are selected from the group consisting of titania particles, alumina particles, and a combination thereof.

5. An organophotoreceptor according to claim 1 wherein the amount of inorganic particles is greater than 20% by weight of the ground stripe.

6. An organophotoreceptor according to claim 1 wherein the surfactant is a silicone surfactant.

7. An electrophotographic imaging apparatus comprising:

(a) a plurality of support rollers, at least one having a diameter no greater than about 40 mm; and (b) an organic photoreceptor in the form of a flexible belt threaded around said support rollers, said organophotoreceptor comprising:

(i) at least one photoconductive element capable of retaining an electrophotographic latent image;
(ii) an electrically conductive substrate having an electrically conductive surface; and
(iii) an electrically conductive ground stripe adjacent to the photoconductive element and in electrical contact with the electrically conductive substrate, wherein the electrically conductive ground stripe comprises a film forming binder, conductive particles, and inorganic particles having a Mohs hardness greater than 5;
(iv) at least a charge transport compound; and
(v) at least a charge generating compound.

8. The electrophotographic imaging apparatus of claim 7 wherein the conductive stripe also comprises a surfactant.

9. An electrophotographic imaging apparatus according to claim 8 wherein the conductive particles are carbon black particles.

10. An electrophotographic imaging apparatus according to claim 8 wherein the inorganic particles are selected from the group consisting of titania particles, alumina particles, and a combination thereof.

11. An electrophotographic imaging apparatus according to claim 8 wherein the surfactant comprises a silicone surfactant.

12. An electrophotographic imaging process comprising:
(a) applying an electrical charge to a surface of an organophotoreceptor comprising:
(i) at least one photoconductive element capable of retaining an electrophotographic latent image;
(ii) an electrically conductive substrate having an electrically conductive surface; and
(iii) an electrically conductive ground stripe adjacent to the photoconductive element and in electrical contact with the electrically conductive substrate, wherein the electrically conductive ground stripe comprising a film forming binder, conductive particles, inorganic particles having a Mohs hardness greater than 5, and a surfactant;
(iv) at least a charge transport compound; and
(v) at least a charge generating compound;
(b) imagewise exposing said surface of said organic photoreceptor to radiation to dissipate charge in selected areas and thereby form a pattern of charged and uncharged areas on said surface;
(c) contacting said surface with a liquid toner comprising a dispersion of colorant particles in an organic liquid to create a toned image; and
(d) transferring said toned image to a substrate.

13. An electrophotographic imaging process according to claim 12 wherein the conductive particles are carbon black particles.

14. An electrophotographic imaging process according to claim 12 wherein the inorganic particles are selected from the group consisting of titania particles, alumina particles, and a combination thereof.

15. An electrophotographic imaging process according to claim 11 wherein the surfactant comprises a silicone surfactant.

16. An electrically conductive ground stripe comprising:
(a) a film forming binder;
(b) conductive particles;
(c) inorganic particles having a Mohs hardness greater than 5; and
(d) a surfactant.

17. An electrically conductive ground stripe according to claim 16 wherein the amount of inorganic particles is greater than 20% by weight.

18. An electrically conductive ground stripe according to claim 16 wherein the conductive particles are carbon black particles.

19. An electrically conductive ground stripe according to claim 18 wherein the inorganic particles are selected from the group consisting of titania particles, alumina particles, and a combination thereof.

20. An electrically conductive ground stripe according to claim 16 wherein the surfactant comprises a silicone surfactant.

21. A process of making a ground stripe comprising the steps of:
(a) dispersing inorganic particles having a Mohs hardness greater than 5 in a first liquid to form a first inorganic particle dispersion;
(b) dispersing a mixture of conductive particles, a surfactant, a binder, and said first inorganic particle dispersion in a second liquid to form a ground stripe dispersion;
(c) coating said ground stripe dispersion on a substrate; and
(d) hardening said ground stripe dispersion on said substrate.

22. A process of making a ground stripe according to claim 21 wherein a combination of at least two surfactants is used in step (a).

23. A process of making a ground stripe according to claim 21 wherein the conductive particles are carbon black particles.

24. A process of making a ground stripe according to claim 21 wherein the inorganic particles are selected from the group consisting of titania particles, alumina particles, and a combination thereof.

25. A process of making a ground stripe according to claim 21 wherein the surfactant comprises a silicone surfactant.

26. A process of making a ground stripe comprising the steps of:
(a) dispersing inorganic particles having a Mohs hardness greater than 5 in a first liquid to form an inorganic particle dispersion;
(b) dispersing a mixture of conductive particles, a surfactant, and a binder in a second liquid to form a conductive particle dispersion;
(c) mixing or dispersing said inorganic particle dispersion and said conductive particle dispersion together to form a ground stripe dispersion; (d) coating said ground stripe dispersion on a substrate; and
(e) drying said ground stripe dispersion on said substrate.

27. A process of making a ground stripe according to claim 26 wherein the conductive particles are carbon black particles.

28. A process of making a ground stripe according to claim 26 wherein the inorganic particles are selected from the group consisting of titania particles, alumina particles, and a combination thereof.

29. A process of making a ground stripe according to claim 24 wherein the surfactant comprises a silicone surfactant, the conductive particles are carbon black particles, and the inorganic particles are selected from the group consisting of titania particles, alumina particles, and a combination thereof.

30. A process of making a ground stripe comprising the steps of:
(a) mixing inorganic particles having a Mohs hardness greater than 5 in a first liquid to form a first inorganic particle dispersion;

(b) dispersing a mixture of conductive particles, a binder, and said the first inorganic particle dispersion in a second liquid to form a ground stripe dispersion;

(c) mixing or dispersing said ground stripe dispersion with a surfactant;

(d) coating said ground stripe dispersion on a substrate; and (e) drying said ground stripe dispersion on said substrate.

31. A process of making a ground stripe according to claim 30 wherein the conductive particles are carbon black particles.

32. A process of making a ground stripe according to claim 30 wherein the inorganic particles are selected from the group consisting of titania particles, alumina particles, and a combination thereof.

33. A process of making a ground stripe according to claim 30 wherein the surfactant comprises a silicone surfactant.

34. The electrophotographic imaging apparatus of claim 7 wherein the conductive particles are carbon black particles, and the inorganic particles are selected from the group consisting of titania particles, alumina particles, and a combination thereof.

35. The electrophotographic imaging apparatus of claim 8 wherein the conductive particles are carbon black particles, and the inorganic particles are selected from the group consisting of titania particles, alumina particles, and a combination thereof.

36. The electrophotographic imaging process of claim 12 wherein the conductive particles are carbon black particles, and the inorganic particles are selected from the group consisting of titania particles, alumina particles, and a combination thereof.

37. The electrophotographic imaging apparatus of claim 7 wherein the conductive particles are carbon black particles, and the inorganic particles are selected from the group consisting of silicon dioxide, aluminum oxide, titanium dioxide, alpha-$Fe_2O_3$, $Fe_3O_4$, Mg), $SnO_2$, $ZrO_2$, quartz, topaz, $MgAl_2O_4$, SiC, diamond, and $BeAl_2O_4$ and a combination thereof.

38. The electrophotographic imaging apparatus of claim 8 wherein the conductive particles are carbon black particles, and the inorganic particles are selected from the group consisting of silicon dioxide, aluminum oxide, titanium dioxide, alpha-$Fe_2O_3$, $Fe_3O_4$, Mg), $SnO_2$, $ZrO_2$, quartz, topaz, $MgAl_2O_4$, SiC, diamond, and $BeAl_2O_4$ and a combination thereof.

39. The electrophotographic imaging process of claim 12 wherein the conductive particles are carbon black particles, and the inorganic particles are selected from the group consisting of silicon dioxide, aluminum oxide, titanium dioxide, alpha-$Fe_2O_3$, $Fe_3O_4$, Mg), $SnO_2$, $ZrO_2$, quartz, topaz, $MgAl_2O_4$, SiC, diamond, and $BeAl_2O_4$ and a combination thereof.

* * * * *

UNITED STATES PATENT AND TRADEMARK OFFICE

CERTIFICATE OF CORRECTION

PATENT NO. : 6,673,499 B2 
DATED : January 6, 2004
INVENTOR(S) : Nam Jeong Lee, Zbigniew Torkarski and Lam Wah Law It is certified that error appears in the above-identified patent and that said Letters Patent is hereby corrected as shown below:

Column 3,
Line 6, please insert a -- . -- after "compound".

Column 4,
Line 3, please insert a -- . -- after "substrate".
Line 65, please delete "of".

Column 7,
Line 21, please delete "comprises" and insert -- comprise --.

Column 9,
Line 5, please delete "Coming" and insert -- Corning --.

Column 15,
Line 1, please insert -- different from said inorganic particles -- after "particles".

Signed and Sealed this

Twenty-first Day of June, 2005

JON W. DUDAS
*Director of the United States Patent and Trademark Office*